US005287116A

United States Patent [19]

Iwasaki et al.

[11] Patent Number: 5,287,116

[45] Date of Patent: Feb. 15, 1994

[54] ARRAY ANTENNA GENERATING CIRCULARLY POLARIZED WAVES WITH A PLURALITY OF MICROSTRIP ANTENNAS

[75] Inventors: Hisao Iwasaki, Tokyo; Hisashi Sawada, Kanagawa, both of Japan

[73] Assignee: Kabushiki Kaisha Toshiba, Kawagawa, Japan

[21] Appl. No.: 891,163

[22] Filed: May 29, 1992

[30] Foreign Application Priority Data

| | | | |
|---|---|---|---|
| May 30, 1991 | [JP] | Japan | 3-126403 |
| Aug. 30, 1991 | [JP] | Japan | 3-220639 |
| Sep. 27, 1991 | [JP] | Japan | 3-249909 |
| Nov. 25, 1991 | [JP] | Japan | 3-309135 |

[51] Int. Cl.[5] ..... H01Q 1/38; H01Q 13/08; H01Q 21/22; H01Q 21/24

[52] U.S. Cl. ..... 343/700 MS; 343/853

[58] Field of Search ..... 343/700 MS File, 853, 343/857, 858; 333/24 R; H01Q 1/38, 13/08

[56] References Cited

U.S. PATENT DOCUMENTS

| | | | |
|---|---|---|---|
| 4,771,291 | 9/1988 | Lo et al. | 343/700 MS |
| 4,937,585 | 6/1990 | Shoemaker | 343/700 MS File |
| 4,962,383 | 10/1990 | Tresselt | 343/700 MS |
| 5,201,065 | 4/1993 | Nichenke | 343/700 MS |

FOREIGN PATENT DOCUMENTS

| | | | |
|---|---|---|---|
| 0207029 | 12/1986 | European Pat. Off. | 343/700 MS |
| 0360692 | 3/1990 | European Pat. Off. | 343/700 MS |
| 0434268 | 6/1991 | European Pat. Off. | 343/700 MS |
| 0116202 | 4/1990 | Japan | 343/700 MS File |
| 0211703 | 8/1990 | Japan | H01Q 21/24 |

OTHER PUBLICATIONS

Z. Rong-Hua, Microstrip CP Antenna For Dual Frequency Bands Operation, 1986 Int. Symp. Dig. Ant. & Prop., vol. II, IEEE, pp. 845-848.

Watkins et al., Experimental Investigation of Broad--Band Microstrip Antennas, IEEE 1990 Int. Radar Conf., Arlington Va., May 7-10, 1990, pp. 496-500.

Legay et al., Theoretical And Experimental Analysis of a Circ. Polarized Notched Antenna Fed Electromagnetically By One Microstrip Line, 1990 INt. symp. Dig., vol. II, IEEE, pp. 644-647.

IEEE International Symposium on Antenna and Propagations—Society by E. Rammos and A. Roederer "Self Diplexing Circularly Polarised Antenna" (May 1990) pp. 803-806.

IEICE Transactions on Antenna and Propagations A. P86-60 "Microstrip Array Antenna for Aeronautical Satellite Communications" by T. Shiokawa et al., (Aug. 1986) pp. 23-27.

*Primary Examiner*—Rolf Hille
*Assistant Examiner*—Peter Toby Brown
*Attorney, Agent, or Firm*—Finnegan, Henderson, Farabow, Garrett & Dunner

[57] ABSTRACT

A microstrip antenna is disclosed which comprises a ground conductor plate and a patch opposed to the ground conductor plate with a particular distance, a transmission feed line and a reception feed line being disposed between the ground conductor plate and the patch. Signals are fed from these feed lines to the patch by electromagnetic coupling. The angle made by the extended lines of these feed lines is nearly 90°. When four patches are disposed in a square arrangement, the transmission feed line feeds signals in directions of first lines which pass through the center point of each patch in such a way that the directions are line-symmetrical with respect to a horizontal line and a vertical line which pass through the center point of the square arrangement. On the other hand, the reception feed line feeds signals in the directions of second lines which pass through the center point of each patch and intersect with each first line at right angle. As a result, the mutual coupling between transmission and reception can be suppressed to a low level. In addition, when the transmission feed line is radiately connected from the center point of the square arrangement to each patch, the length thereof can be reduced, thereby decreasing the transmission loss.

5 Claims, 19 Drawing Sheets

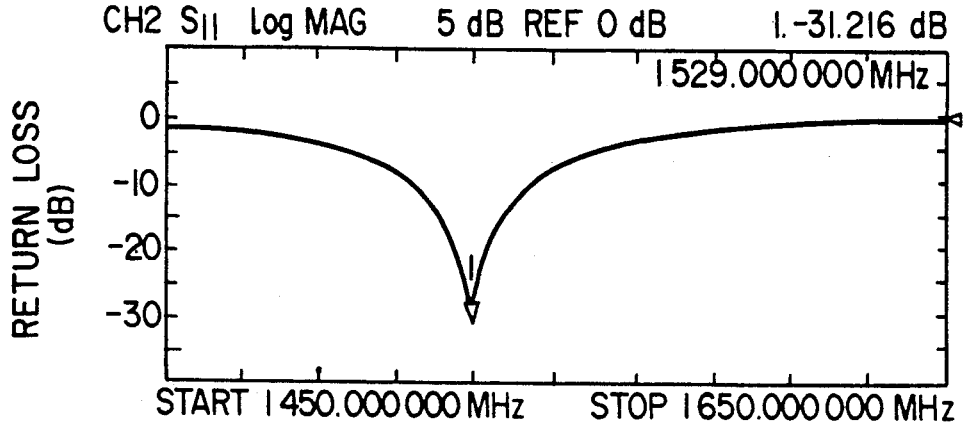
FIG. 4(A) RETURN LOSS IN VIEW OF FEED LINE 3
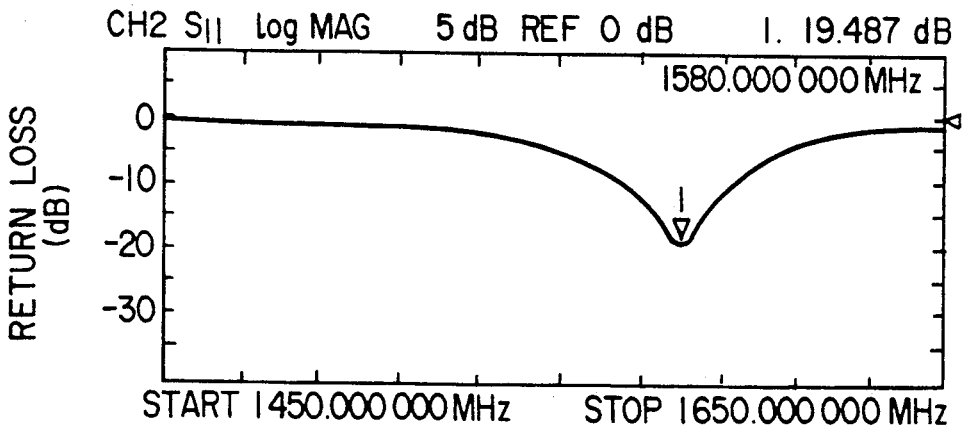
FIG. 4(B) RETURN LOSS IN VIEW OF FEED LINE 4
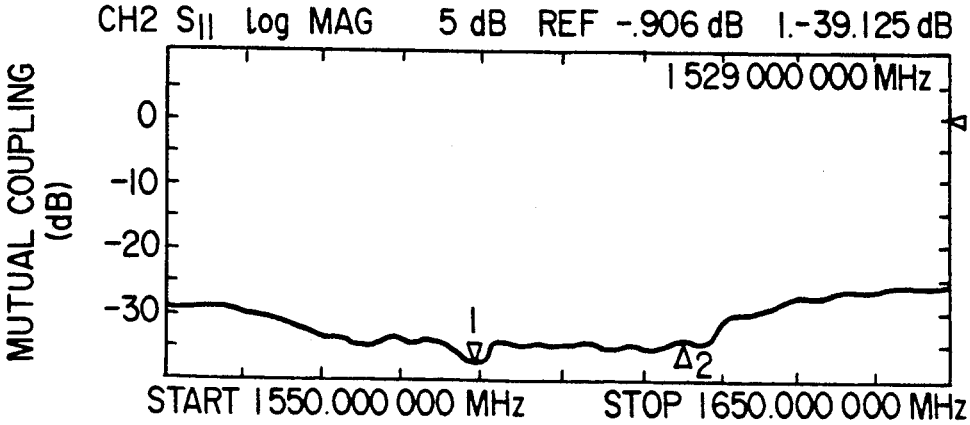
FIG. 4(C) MUTUAL COUPLING BETWEEN FEED LINES 3 AND 4

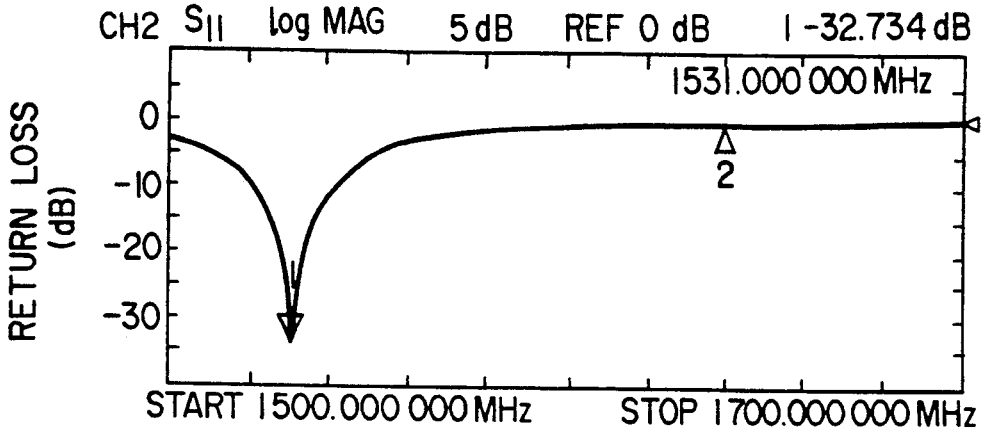
FIG. 8(A) RETURN LOSS IN VIEW OF FEED LINE 3
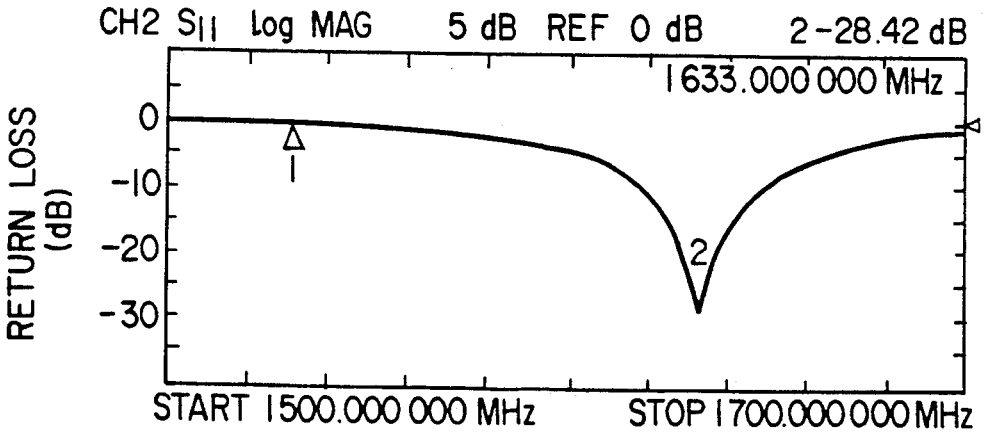
FIG. 8(B) RETURN LOSS IN VIEW OF FEED LINE 4
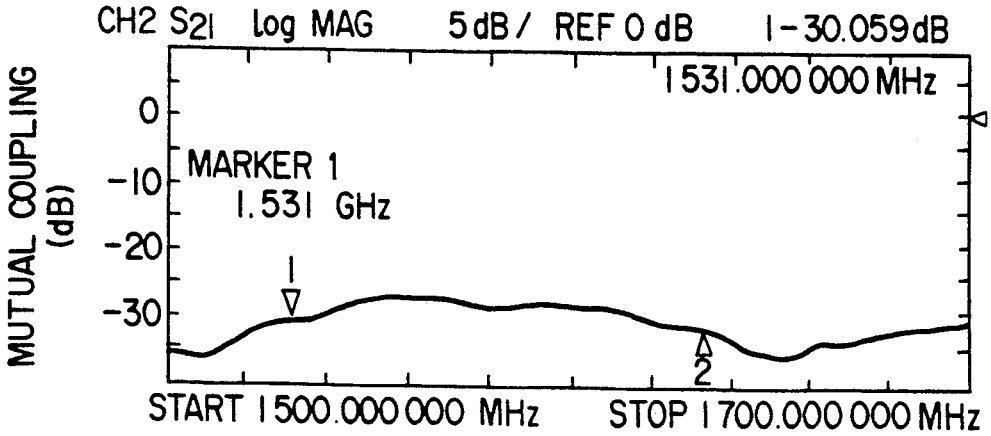
FIG. 8(C) MUTUAL COUPLING BETWEEN FEED LINES 3 AND 4

ANTENNA ELEMENT PORTION

FEED CIRCUIT PORTION

ANTENNA ELEMENT PORTION

FEED CIRCUIT PORTION

E PLANE MUTUAL COUPLING

H PLANE MUTUAL COUPLING

MUTUAL COUPLING
BETWEEN TRANSMISSION AND RECEPTION

FIG. 25(A)
PRIOR ART
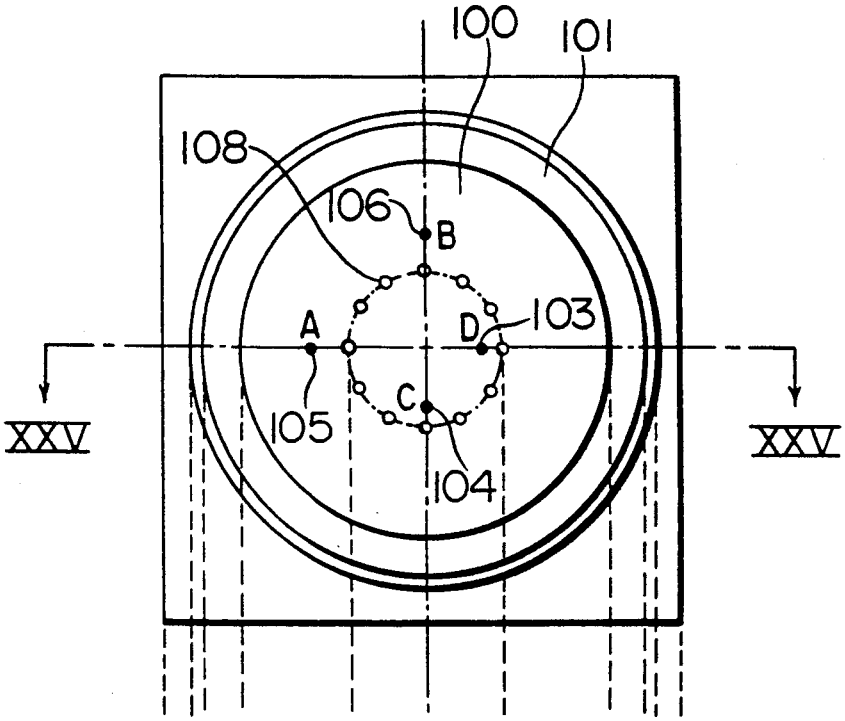
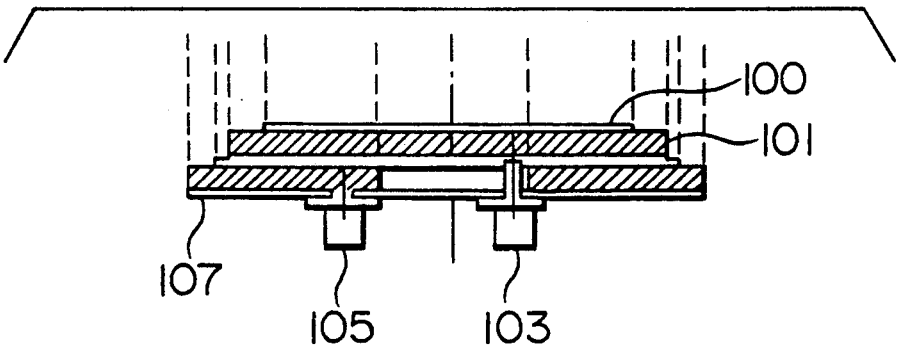
FIG. 25(B)
PRIOR ART

ARRAY ANTENNA GENERATING CIRCULARLY POLARIZED WAVES WITH A PLURALITY OF MICROSTRIP ANTENNAS

BACKGROUND OF THE INVENTION

1. Field of the Invention

The present invention relates to a microstrip antenna for mobile communication use, the antenna comprising a dielectric substrate, a patch, and a ground conductor plate, the patch and the ground conductor plate being disposed on one surface and the other surface of the dielectric substrate.

2. Description of the Related Art

In mobile satellite communication systems, communications are made between a mobile station and a base station and between mobile stations. An antenna for such systems should be small and light weight. In addition, the antenna is required to transmit and receive circularly polarized radio waves with different frequencies. Moreover, to secure a predetermined communication quality level, the transmission channel should have output power of several watts or more. In this condition, if the loss of a transmission feed circuit is large, the output power of a power amplifier should be increased. Thus, the size of the power amplifier becomes large. In addition, a decrease of the efficiency of the power amplifier results in heat generation. Thus, the size of the heat sink for the power amplifier becomes large.

When the transmission output becomes large, a device for separating a reception channel from a transmission channel is required so as to prevent a transmission signal from leaking out to a reception signal. As a separating device for use with an antenna which is common to transmission and reception, a diplexer is generally used. On the other hand, for an antenna which is not common to transmission and reception, a filter is used. In particular, for an active array antenna, each antenna element requires one separating device for separating reception from transmission. The size and weight of these separating devices such as diplexers and filters are larger and heavier than those of the antenna elements. As the number of antenna elements increases, the weight and volume of the entire antenna increases. Thus, the spatially occupied region of the antenna becomes large. This large and heavy antenna is not suitable for the antenna of a mobile station. One technique for reducing the size of the antenna is to get the isolation between reception and transmission by the cooperation of the antenna elements to reduce the demand for the filters and the diplexers.

FIG. 25 shows a construction of a microstrip antenna proposed by Shiokawa et al., Microstrip Array for Aeronautical Satellite Communications, IEICE of Japan, Technical Report, A.P86-60.

This antenna is a circularly polarized wave antenna with separate elements for transmission and reception. This antenna uses a frequency selectivity between a transmission patch 100 and a reception patch 101. The isolation between the transmission element and the reception element of this antenna is approximately −28 dB. Since the required isolation is in the range from −60 to −70 dB, a band pass filter should be used to obtain the required isolation level. Moreover, according to this antenna, the transmission patch 100 is superimposed on the reception patch 101, and the area of the antenna is small. However, such structure leads to a complicated construction of the antenna. In addition, since coaxial cables 103, 104, 105, and 106 are used, they should be soldered. Furthermore, to separate the transmission patch 100 from the reception patch 101, the reception patch 101 should be formed in a ring shape. Thus, a short conductor plate 107 should be shortcircuited to the reception patch 101 with a large number of short pins 108. Therefore, the construction of the antenna is complicated, thereby increasing the number of the production steps and raising the production cost. In addition, to generate a circularly polarized wave, a 90° hybrid for generating a phase difference of 90° should be provided between the coaxial cables 105 and 106.

FIG. 26 is a plan view showing a construction of a conventional microstrip antenna having four antenna elements for both transmission and reception. Signals are fed with feed lines on the same plane. The antenna generates circularly polarized waves. This antenna has been disclosed in Japanese Patent Laid-open Publication Serial No. HEI 2-116202.

As shown in the figure, according to this microstrip antenna, a microstrip line 141 arranged on the same surface of the rectangular patch 140*a* feeds a signal directly to an edge of the rectangular patch 140*a*, thereby generating a horizontally polarized wave with a frequency $f_1$. On the other hand, a microstrip line 142 feeds a signal directly to the rectangular patch 140*a*, thereby generating a vertically polarized wave with a frequency $f_2$. This antenna is provided with four rectangular patches 140*a*, 140*b*, 140*c*, and 140*d* as antenna elements. These rectangular patches 140*a*, 140*b*, 140*c*, and 140*d* are disposed in such a way that angles therebetween are 90° on the same plane. In addition, two signals with frequencies $f_1$ and $f_2$ and a phase difference of 90° are fed to each rectangular patch, thereby generating circularly polarized waves. However, the input impedance at the edge of the rectangular patch 140*a* is in the range from 200 to 300 Ω, whereas the characteristic impedance of the feed line is 50 Ω. Thus, to match these impedances, transformers having a line length of λ g/4 should be provided for both transmission and reception. Moreover, since this antenna is an array antenna, these transformers should be provided for each antenna element. Further, to perform beam scanning with a wide angle, the length of the interval between elements of the array antenna should be about a half wavelength of the signal. Thus, in a limited space, a feed line including an impedance transformer with a line length of λ g/4 should be provided for both transmission and reception. Therefore, since the feed lines come close each other or to the antenna elements, a mutual coupling occurs. Thus, the condition where signals with the same amplitude and a phase difference of 90° should be fed cannot be satisfied. Therefore, a circularly polarized wave cannot be properly generated. In addition, since a mutual coupling occurs between a transmission feed line or a transmission antenna and a reception feed line, the isolation between the transmission band and the reception band is deteriorated. As reported by AP-S90 pp 803-806, SELF DIPLEXING CIRCULARLY POLARIZED ANTENNA, according to this antenna, the isolation between the transmission band and reception band is at most in the range from −20 to −23 dB. Moreover, when the thickness of the substrate is increased for widening the band of the antenna, due to high order mode $TM_{20}$ a mutual coupling occurs between the transmission port and the reception port, thereby deteriorating the isolation between the reception and transmission.

SUMMARY OF THE INVENTION

According to a conventional microstrip antenna, since the antenna should use a conductor pin or the like for feeding a signal to a patch as an antenna element, the construction of the antennas is complicated. When a signal is directly fed to a patch on the same plane, since the impedance of the patch differs from that of a feed line, an impedance transformer is required, thereby increasing the size of the antenna. Further, in the case of an array antenna with a plurality of antenna elements, as the microstrip line becomes long, the transmission loss increases. Thus, the transmission output should be increased. Moreover, when an array antenna is commonly used for both transmission and reception, it is necessary to prevent a mutual coupling where a component of a transmission signal is leaked out a reception portion of the antenna.

A first object of the present invention is to provide a microstrip antenna which is simple, small, and light without necessity of a conductor pin, an impedance transformer, and so forth for easy and low cost production.

Further, a second object of the present invention is to provide an array antenna with microstrip antenna elements, the length of the feed lines being small, the transmission loss being small.

Furthermore, a third object of the present invention is to provide an array antenna with microstrip antenna elements used for both transmission and reception, the antennas having the isolation between transmission and reception by decreasing the amount of leakage of a transmission signal out to a reception port being small, so as to reduce the size of a transmitter and a receiver and decrease production cost of the antenna.

To accomplish these objects, the microstrip antenna according to the present invention comprises a ground conductor plate, a patch opposed to the ground conductor plate with a predetermined distance, a first feed line disposed between the ground conductor plate and the patch, and a second feed line disposed between the ground plate and the patch, the second feed line having an angle of 90° to the first feed line.

Further, in the case of an array antenna using a plurality of antenna elements, the microstrip antenna according to the present invention comprises a feed line for feeding a signal to each of the plurality of antenna elements from a nearly center portion of an area surrounded by the plurality of antenna elements.

Furthermore, in the case of four patches in a square arrangement used for both transmission and reception, the microstrip antenna according to the present invention comprises a transmission feed line for feeding signals in the directions of first lines which pass through the center point of each of the patches in such a way that the feed points are line-symmetrical with respect to a horizontal line and a vertical line which pass through the center point of the square arrangement, and a reception feed line for feeding signals in the directions of second lines which pass through the center point of each patch and intersects with the first lines at a right angle. Thus, the mutual coupling between transmission and reception can be suppressed to a low level.

BRIEF DESCRIPTION OF THE DRAWINGS

FIG. 4 (*a*) is a chart showing the return loss of the feed line 3 of the microstrip antenna shown in FIG. 1;

FIG. 4 (*b*) is a chart showing the return loss of the feed line 4 of the microstrip antenna shown in FIG. 1;

FIG. 4 (*c*) is a chart showing the mutual coupling between the feed line 3 and the feed line 4;

FIG. 8 (*a*) is a chart showing the return loss in view of the feed line 3 in the construction where the length Ls of the slot 6 of the microstrip antenna shown in FIG. 5 is 20 mm and the respective length of the feed lines 3 and 4 is 25 mm;

FIG. 8 (*b*) is a chart showing the return loss in view of the feed line 4 in the construction where the length Ls of the slot 6 of the microstrip antenna shown in FIG. 5 is 20 mm and the respective length of the feed lines 3 and 4 is 25 mm;

FIG. 8 (*c*) is a chart showing the mutual coupling between the feed lines 3 and 4 in the construction where the length Ls of the slot 6 of the microstrip antenna shown in FIG. 5 is 20 mm and the respective length of the feed lines 3 and 4 is 25 mm;

FIG. 25(*a*) shows a construction of a conventional microstrip antenna where a transmission patch is overlaid on a reception patch;

FIG. 25(*b*) is a sectional view taken along XXV—XXV of the microstrip antenna shown in FIG. 25(*a*)

DESCRIPTION OF THE PREFERRED EMBODIMENTS

With reference to the accompanying drawings, embodiments of the present invention will be described.

Figure 1:
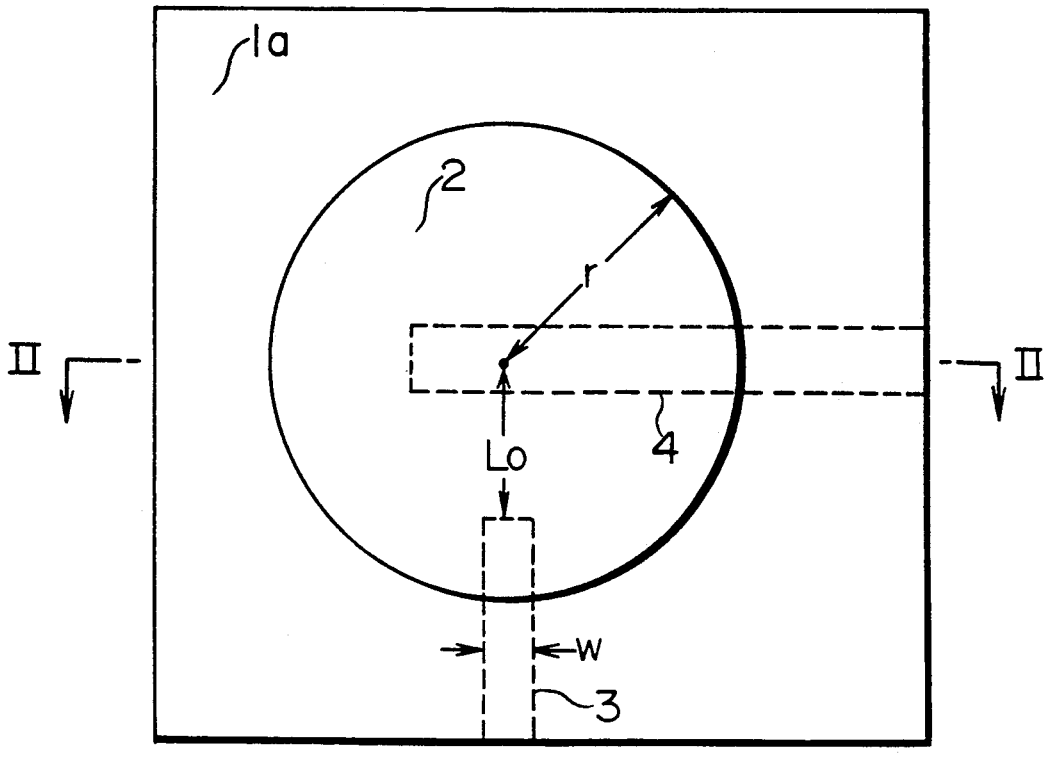
FIG. 1 is a plan view showing a microstrip antenna in accordance with an embodiment of the present invention.
Figure 2:
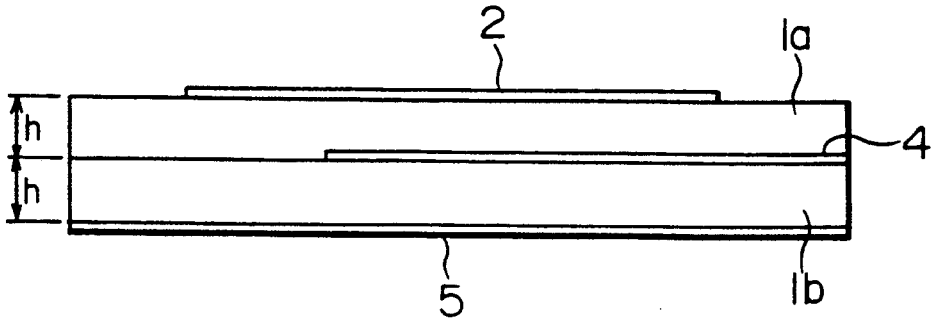
FIG. 2 is a sectional view taken along II—II of the microstrip antenna shown in FIG. 1.

FIG. 1 is a plan view showing a microstrip antenna in accordance with an embodiment of the present invention. FIG. 2 is a sectional view taken along II—II of the microstrip antenna shown in FIG. 1. On one surface of a rectangular dielectric substrate 1*a* with a width h, there is provided a patch 2. The patch 2 is a circular conductor plate with a radius r. On the other surface of the dielectric substrate 1*a*, there is provided a dielectric substrate 1*b* with a thickness h, the dielectric substrate lb being sandwiched with feed lines 3 and 4. The feed lines 3 and 4 are disposed perpendicularly to each other without any overlapping portion. On the rear surface of the dielectric substrate 1*b*, there is provided a ground conductor plate 5.

Figure 3:
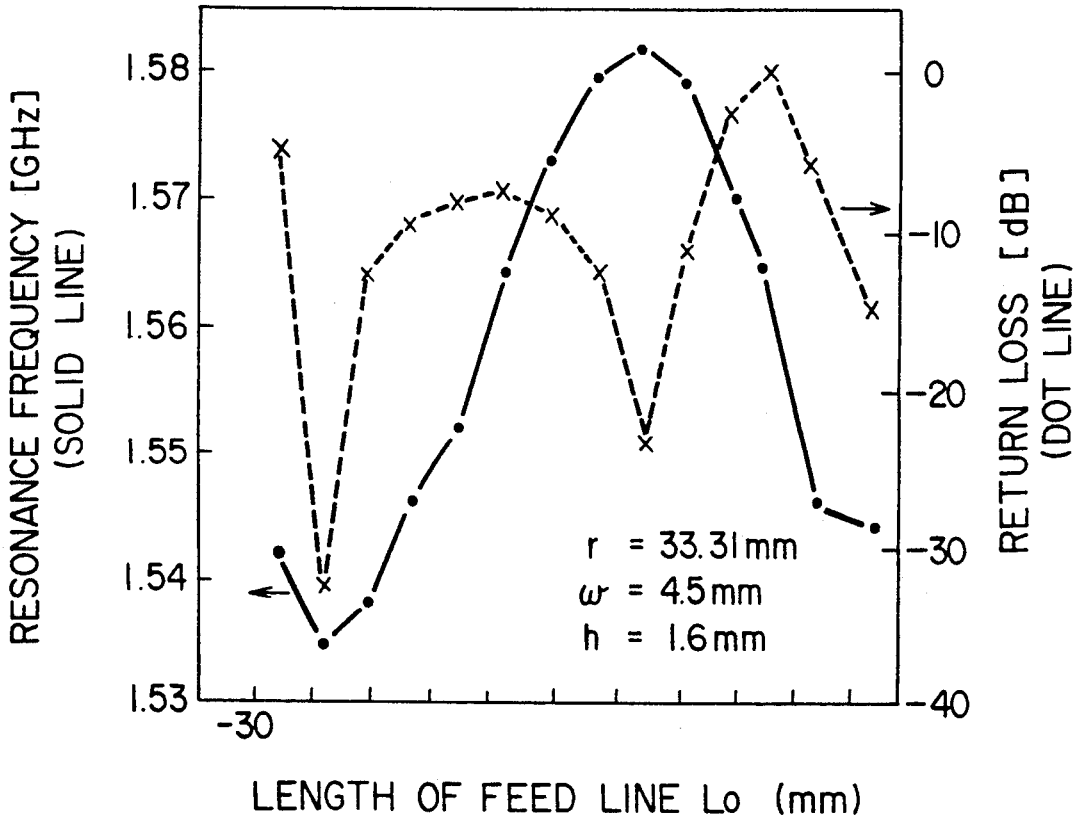
FIG. 3 is a chart showing the relation among the length $L_0$ of feed line (the distance between the center position of a patch 2 and an edge of the feed line), the resonance frequency, and the return loss in the construction where a signal is fed by only a feed line 3 without a feed line 4 (shown in FIG. 1) and thereby the microstrip antenna is excited.

FIG. 3 is a chart showing the relation among the length $L_0$ of a feed line (the distance between the center position of a patch 2 and an edge of the feed line), the resonance frequency, and the return loss in the construction where a signal is fed by only a feed line 3 without a feed line 4 (shown in FIG. 1) and thereby the microstrip antenna is excited. In the figure, the solid line represents the resonance frequency. The dot line represents the return loss.

The length $L_0$ of feed line is measured from the center position of the patch 2. This center position is defined as the origin of the patch 2. When the end of the feed line 3 exceeds the center position of the patch 2, a plus sign is added to the length $L_0$ of feed line. In contrast, when the end of the feed line 3 does not exceed the center position of the patch 2, a minus sign is added to the length $L_0$ of feed line.

As shown in FIG. 3, the resonance frequency varies depending on the length $L_0$ of the feed line. When the length of the feed line is around 25 mm or around 5 mm, minimal values of the return loss are obtained. Thus, it is found that the impedance of the patch can be matched with that of the feed line (with an impedance of 50 Ω).

In a conventional probe signal feeding using a semi-rigid cable or the like, the resonance frequency of the microstrip antenna is determined by the radius r of the patch. When a signal is fed as shown in FIGS. 1 and 2, even if the radius r of the patch is constant, the resonance frequency varies depending on the length $L_0$ of the feed line. In other words, the resonance frequency can be controlled by the length $L_0$ of the feed line. As a result, in the antenna shown in FIG. 1, when the lengths of the feed lines 3 and 4 are 25 mm and 5 mm, respectively, the antenna can operate with dual frequencies.

FIG. 4 (*a*) is a chart showing the return loss in view of the feed line 3 of the microstrip antenna shown in FIG. 1.

FIG. 4 (*b*) is a chart showing the return loss in view of the feed line 4 of the microstrip antenna shown in FIG. 1. FIG. 4 (*c*) is a chart showing the mutual coupling between the feed line 3 and the feed line 4.

As shown in FIG. 4 (*a*), the resonance frequency in view of the feed line 3 is 1.529 GHz. In addition, as shown in FIG. 4 (*b*), the resonance frequency in view of the feed line 4 is 1.58 GHz. Moreover, as shown in FIG. 4 (*c*), the mutual coupling between the feed lines 3 and 4 is approximately −35 dB. According to FIGS. 4 (*a*), (*b*), and (*c*), it is found that the microstrip antenna shown in FIG. 1 securely operates with dual frequencies.

In the above embodiment shown in FIGS. 1 and 2, the feed lines 3 and 4 are disposed on the same plane. However, the feed lines 3 and 4 can be disposed on different planes, respectively.

Figure 5:
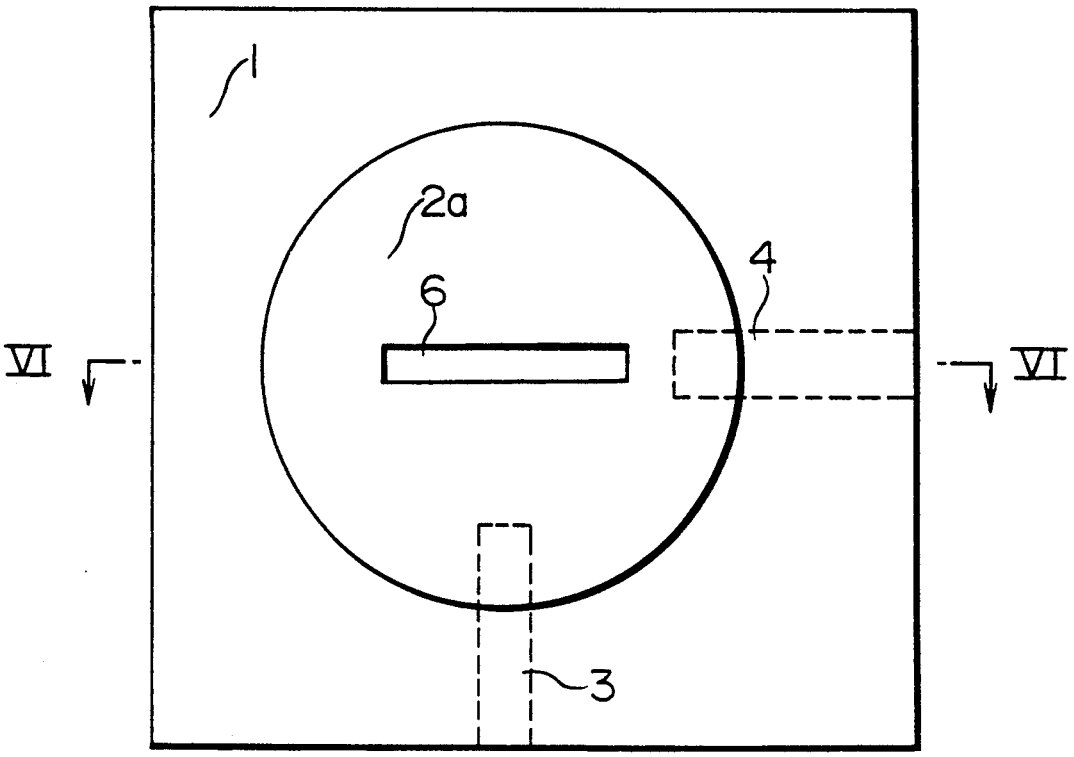
FIG. 5 is a plan view showing a microstrip antenna having a patch 2*a* with a slot 6 instead of the patch 2 shown in FIG. 1.
Figure 6:
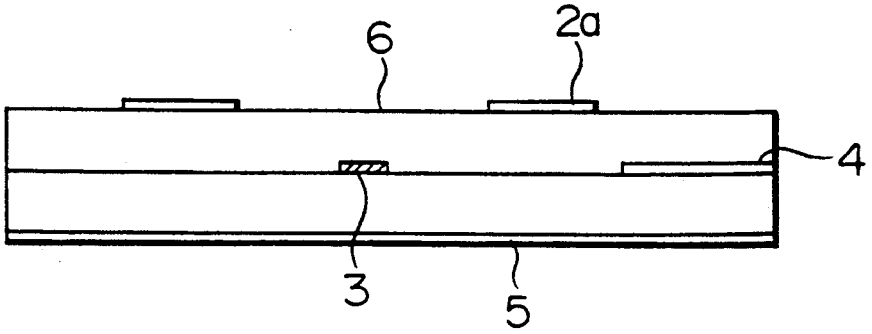
FIG. 6 is a sectional view taken along VI—VI of the microstrip antenna shown in FIG. 5.

FIG. 5 is a plan view showing a microstrip antenna having a patch 2*a* with a slot 6 instead of the patch 2 shown in FIG. 1. FIG. 6 is a sectional view taken along VI—VI of the microstrip antenna shown in FIG. 5. As shown in these figures, the slot 6 is disposed on an extended line of the feed line 4 and this extended line is perpendicular to an extended line of the feed line 3.

Figure 7:
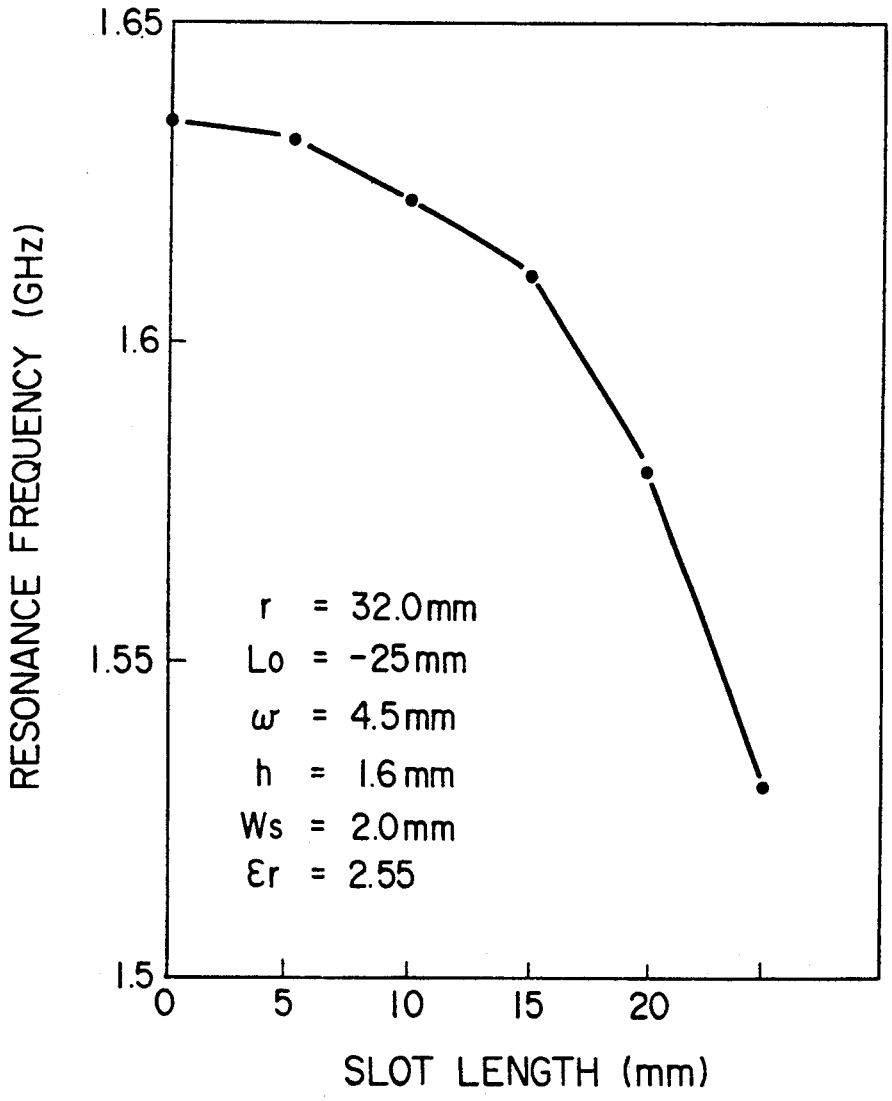
FIG. 7 is a chart showing the relation between the length Ls of the slot 6 and the resonance frequency in the construction where the feed line 4 shown in FIG. 5 is removed and the length of the feed line 3 is 25 mm.

FIG. 7 is a chart showing the relation between the length Ls of the slot 6 and the resonance frequency in the construction where the feed line 4 shown in FIG. 5 is removed and the length of the feed line 3 is 25 mm. In FIG. 7, the slot width $W_s$ is 2.0 mm; the relative permittivity $\epsilon_r$ of the dielectric substrate 1 is 2.55; and the radius of the patch 2 is 32.00 mm. As shown in the figure, as the slot 6 becomes long, the resonance frequency monotonously decreases. In addition, when a signal is fed by only the feed line 4 without the feed line 3 in the microstrip antenna shown in FIG. 5, the resonance frequency is not remarkably affected by the length Ls of the slot 6. Thus, when signals are fed by the feed lines 3 and 4, the microstrip antenna can operate with dual frequencies.

FIG. 8 (*a*) is a chart showing the return loss in view of the feed line 3 in the construction where the length Ls of the slot 6 of the microstrip antenna shown in FIG. 5 is 20 mm and the lengths of the feed lines 3 and 4 are 23 mm and 25 mm respectively. FIG. 8 (*b*) is a chart showing the return loss in view of the feed line 4 in the construction where the length Ls of the slot 6 of the microstrip antenna shown in FIG. 5 is 20 mm and the lengths of the feed lines 3 and 4 are 23 mm and 25 mm respectively. FIG. 8 (*c*) is a chart showing the mutual coupling between the feed lines 3 and 4 in the construction where the length Ls of the slot 6 of the microstrip antenna shown in FIG. 5 is 20 mm and the lengths of the feed lines 3 and 4 are 23 mm and 25 mm respectively.

As shown in FIG. 8 (*a*), the resonance frequency in view of the feed line 3 is 1.531 GHz. In addition, as shown in FIG. 8 (*b*), the resonance frequency of the feed line is 1.633 GHz. Moreover, as shown in FIG. 8 (*c*), the mutual coupling between the feed lines 3 and 4 is approximately −32 dB. According to FIGS. 8 (*a*), (*b*), and (*c*), it is found that the microstrip antenna shown in FIG. 5 is operating for dual frequencies.

Figure 9:
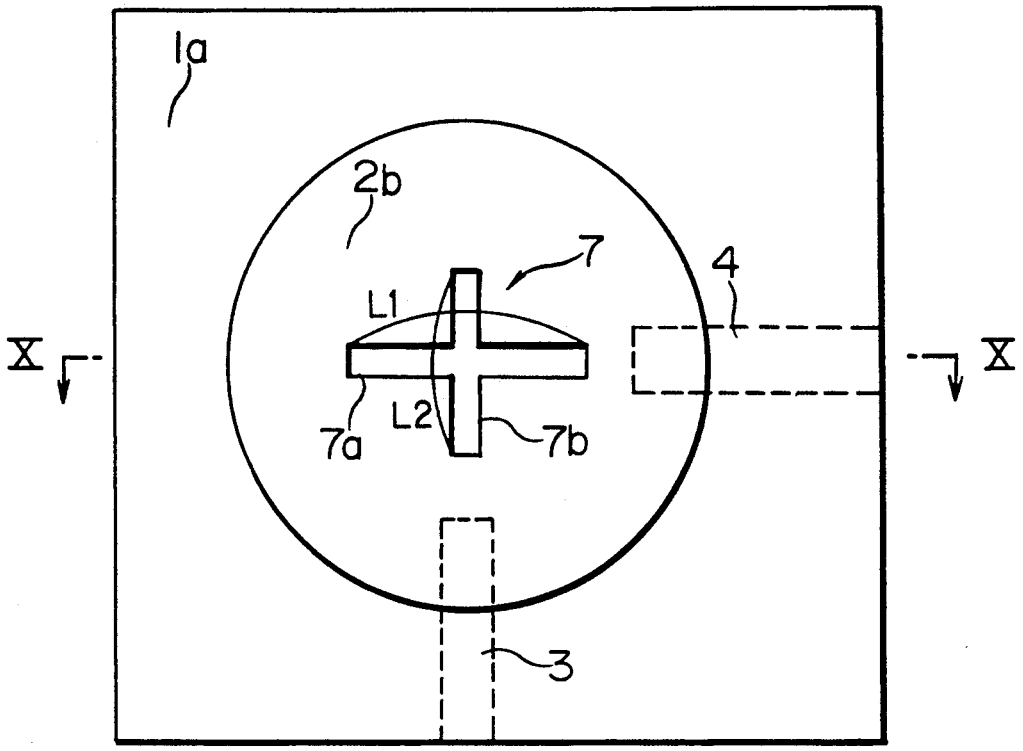
FIG. 9 is a plan view showing a construction of a microstrip antenna having a patch 2*b* with a cross slot 7 at a center position of the patch 2 shown in FIG. 1.
Figure 10:
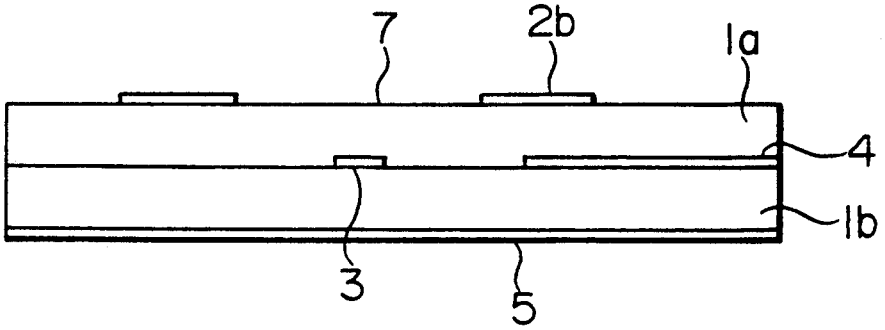
FIG. 10 is a sectional view taken along X—X of the microstrip antenna shown in FIG. 9.

FIG. 9 is a plan view showing a construction of a microstrip antenna having a patch 2*b* with a cross slot 7 at a center position of the patch 2 shown in FIG. 1. FIG. 10 is a sectional view taken along X—X of the microstrip antenna shown in FIG. 9.

When the lengths $L_1$ and $L_2$ of the cross slot 7 are varied, the resonant frequencies in view of the feed lines 3 and 4 are varied. As a result, this microstrip antenna operates with dual frequencies. In this embodiment, the feed lines 3 and 4 are inserted from the respective directions of the slots 7*a* and 7*b* of the cross slot 7, the slot 7*a* being perpendicular to the slot 7*b*. However, the feed lines 3 and 4 may be not disposed on the extended lines of the slots 7*a* and 7*b*, respectively.

Figure 11:
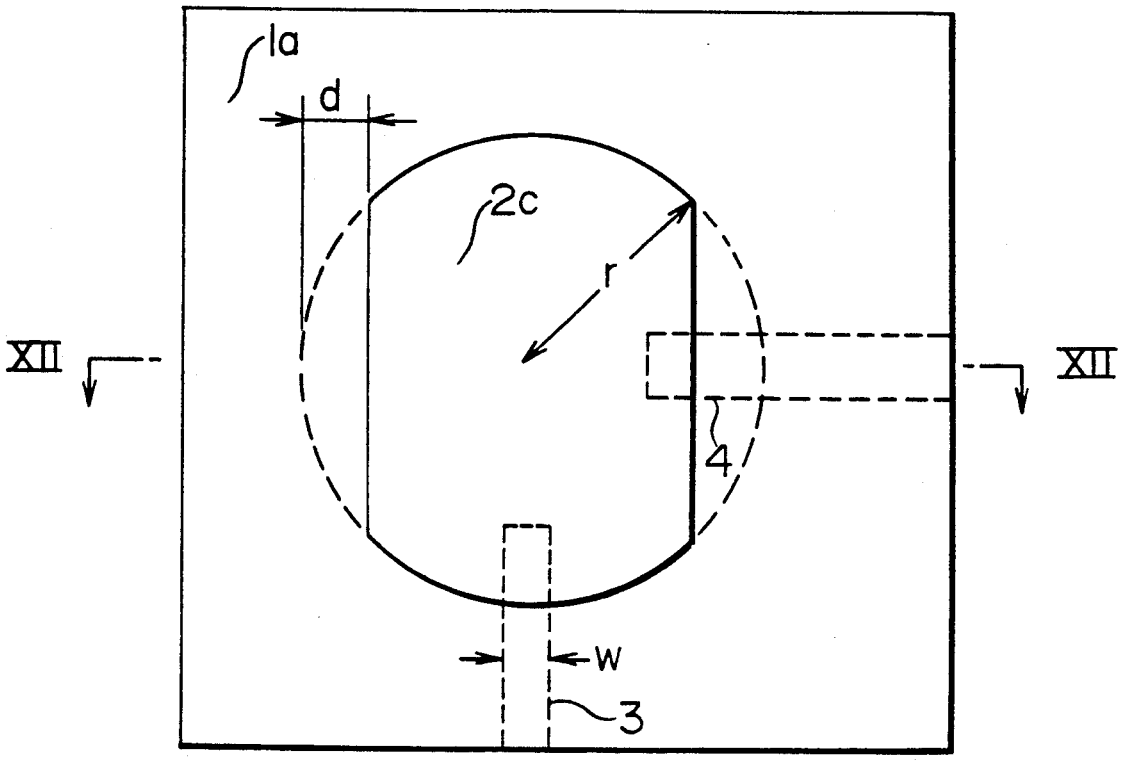
FIG. 11 is a plan view showing a construction of a microstrip antenna having a patch 2*c* in a shape where an edge portion thereof overlapped with the feed line 4 is removed from the microstrip antenna shown in FIG. 1.
Figure 12:
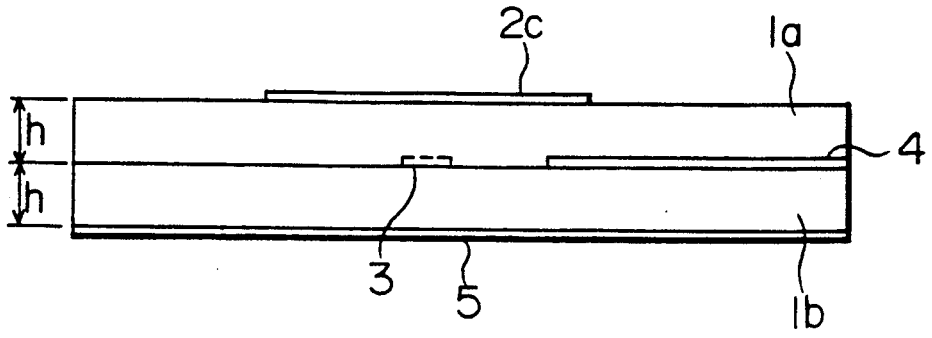
FIG. 12 is a sectional view taken along XII—XII of the microstrip antenna shown in FIG. 11.

FIG. 11 is a plan view showing a construction of a microstrip antenna having a patch 2*c* in a shape where an edge portion thereof overlapped with the extended line of the feed line 4 is removed from the microstrip antenna shown in FIG. 1. FIG. 12 is a sectional view taken along XII—XII of the microstrip antenna shown in FIG. 11.

Figure 13:
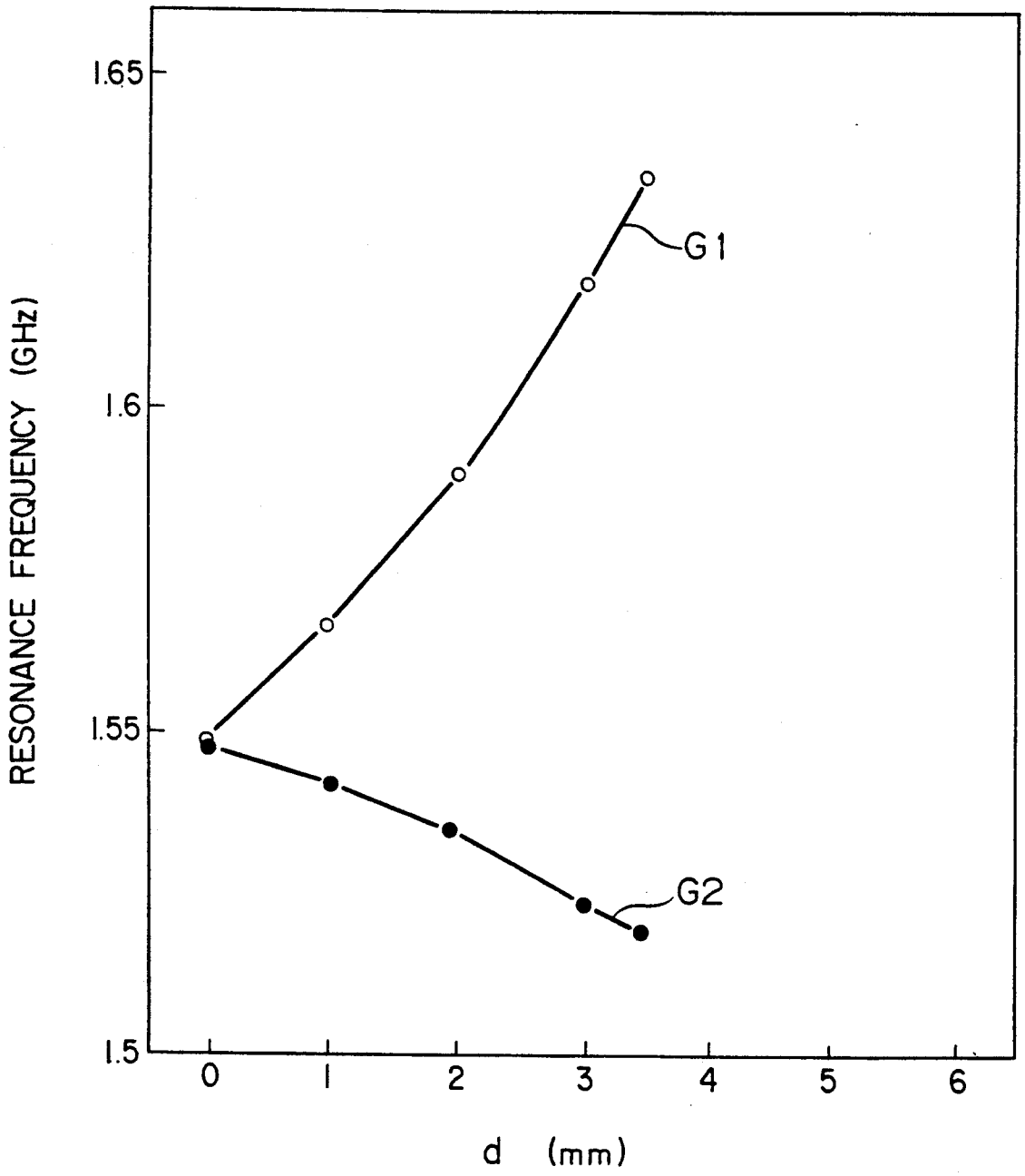
FIG. 13 is a chart showing the relation between the length d of the edge portion being removed and the frequencies of the feed lines 3 and 4.

FIG. 13 is a chart showing the relation between the length d of the edge portion being removed and the frequencies in view of the feed lines 3 and 4. In this chart, the resonant frequencies in view of the feed lines 3 and 4 are represented with G1 and G2, respectively.

Figure 14:
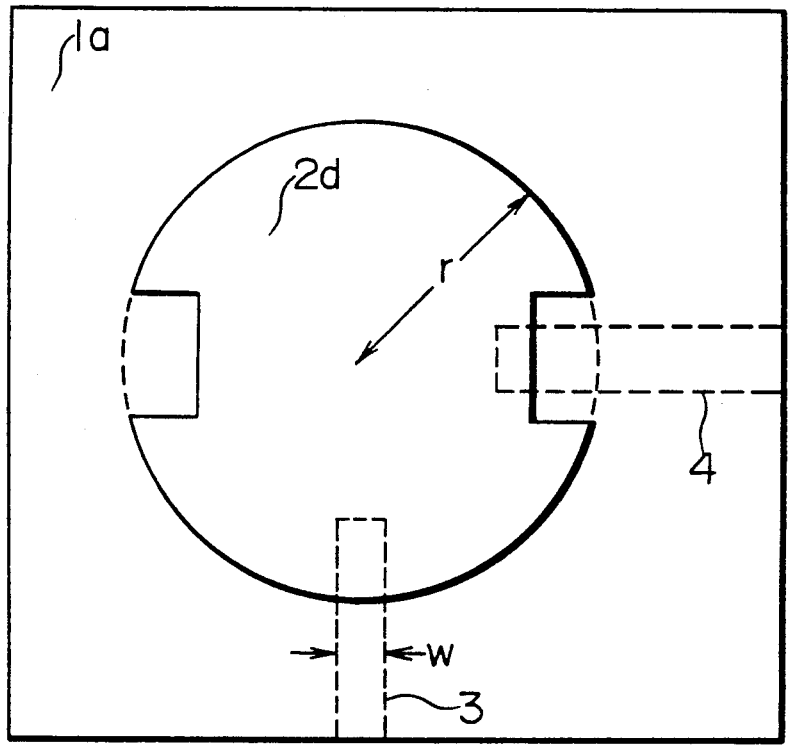
FIG. 14 is a plan view showing a construction of a microstrip antenna having edge portions in a bracket "]" shape, so as to operate the antenna at two frequencies.

As shown in FIG. 13, when the length d of the edge portion to be removed becomes long, the resonance frequency in view of the feed line 3 increases, whereas that of the feed line 4 decreases. Thus, a microstrip antenna which can operate at two frequencies can be accomplished. In the microstrip antenna shown in FIG. 11, the edge portions of the patch 2*c* were removed along the chords thereof. However, as shown in FIG. 14, it is possible to use a patch 2*d* having edge portions in a bracket "]" shape.

Next, a method for generating a circularly polarized wave by using the above mentioned microstrip antenna which operates with dual frequencies will be described. Although the microstrip antennas shown in FIGS. 1, 5, 9, 11, and 14 can generate a circularly polarized wave, the generation method will be described with respect to the microstrip antenna shown in FIG. 1. The resonance frequencies in view of the feed lines 3 and 4 of the microstrip antenna shown in FIG. 1 are denoted by $f_a$ and $f_b$, respectively.

Figure 15:
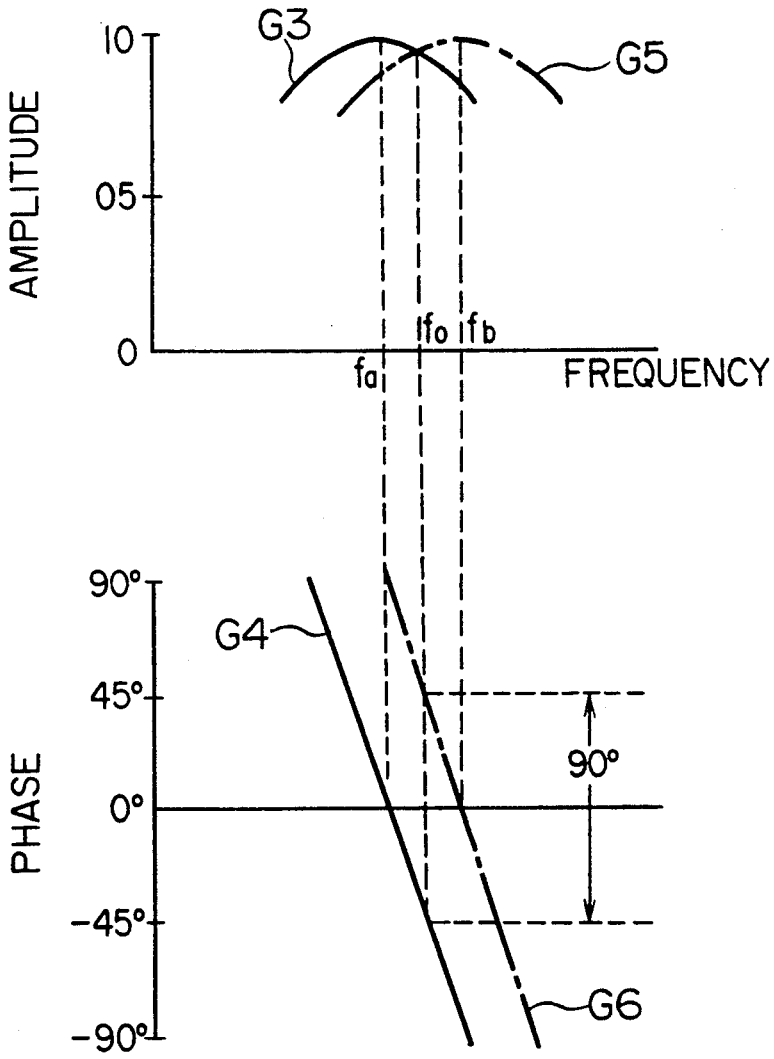
FIG. 15 is a chart showing the relation among the frequency, the amplitude, and the phase of exciting currents of signals supplied to the feed lines 3 and 4 of the microstrip antenna shown in FIG. 1.

FIG. 15 is a chart showing the relation among the frequency, the amplitude, and the phase of exciting currents of signals supplied to the feed lines 3 and 4 of the microstrip antenna shown in FIG. 1. In FIG. 15, a solid curve "G3" represents the relation between the frequency of a signal fed to the feed line 3 and the amplitude of the exciting current; a solid line "G4" represents the relation between the frequency of a signal fed to the feed line 3 and the phase of the exciting current; a dot curve "G5" represents the relation between the frequency of a signal fed to the feed line 4 and the amplitude of the exciting current; and a dot line "G6" represents the relation between the frequency of a signal fed to the feed line 4 and the phase of the exciting current.

As shown in the figure, when a signal with the resonance frequency $f_a$ is fed to the feed line 3, the amplitude of the exciting current becomes maximum and the phase of the exciting current becomes the same as the phase of the voltage (in other words, the phase difference becomes 0°). When the frequency of the signal fed to the feed line 3 is lower than the resonance frequency $f_a$, the amplitude of the exciting current decreases and the phase of the exciting current is followed by the phase of the voltage. When the frequency of the signal fed to the feed line 3 is higher than the resonance frequency $f_a$, the amplitude of the exciting current decreases and the phase of the exciting current is preceded by the phase of the voltage. This situation remains the same for the signal fed to the feed line 4 with respect to the resonance frequency $f_b$.

Now, the frequency which is higher than the resonance frequency $f_a$ and lower than the resonance frequency $f_b$ and where the amplitude of the exciting current fed to the feed line 3 is equal to that fed to the feed line 4 is denoted by $f_0$. When the resonance frequency $f_a$ and the resonance frequency $f_b$ are properly selected, the difference between the phase of the exciting current fed from the feed line 3 and that from the feed line 4 can be 90°. When a signal with the frequency $f_0$ is fed to both the feed lines 3 and 4 at the same time, the amplitude of the exciting current is slightly lower than that of signals with resonance frequencies. However, since the phase difference of the exciting currents fed to the patch 2 becomes 90° and the amplitude of the exciting current fed to the feed line 3 is equal to that fed to the feed line 4, a circularly polarized wave with the frequency $f_0$ is generated.

A construction of an array antenna using a plurality of the microstrip antennas, each of which was shown in FIGS. 1, 5, 9, 11, and 14, will be described.

Figure 16:
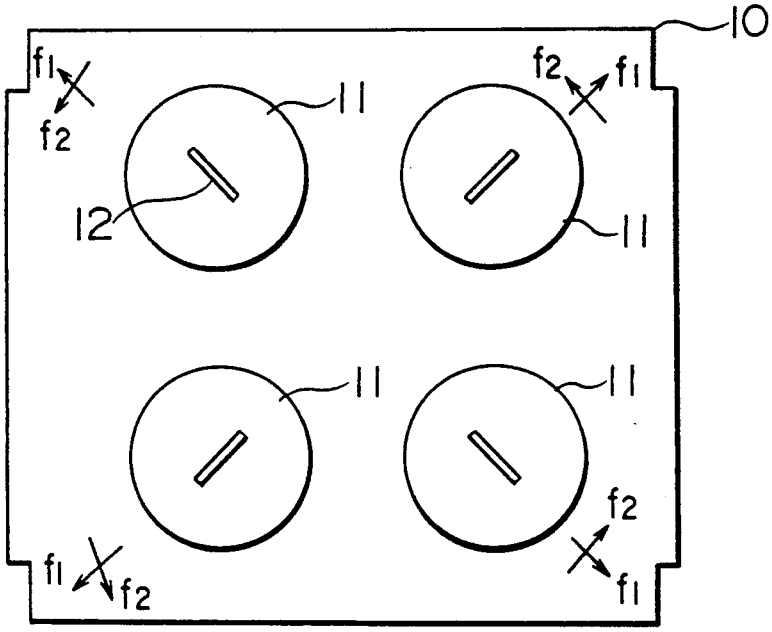
FIG. 16 is a plan view showing an antenna element portion of an array antenna which is constructed of four antenna elements.
Figure 17:
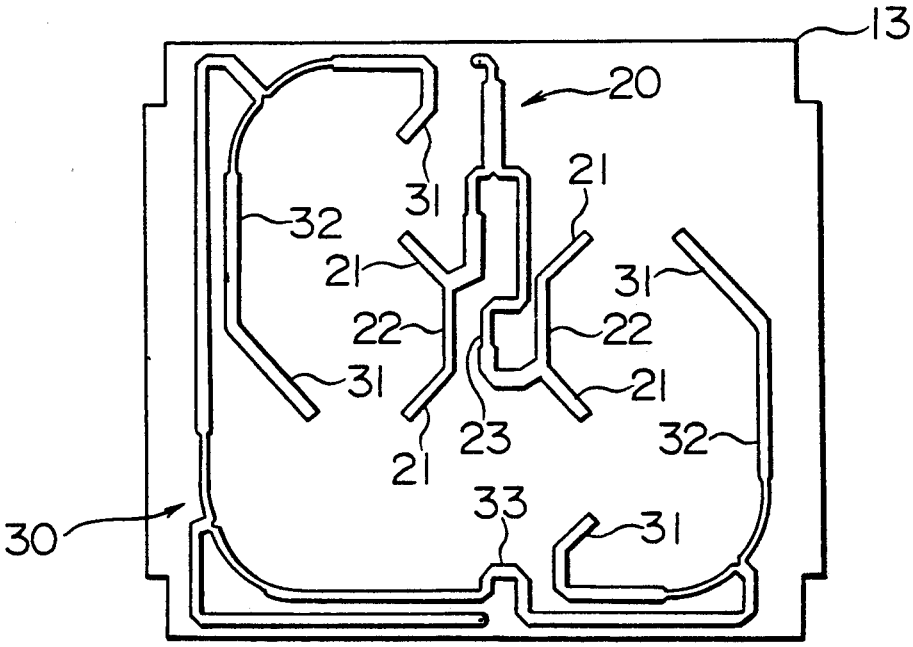
FIG. 17 is a plan view showing a feed line portion of the array antenna shown in FIG. 16.

FIG. 16 is a plan view showing an antenna element portion of an array antenna which is constructed of four antenna elements. FIG. 17 is a plan view showing a feed line portion of the array antenna shown in FIG. 16.

As shown in FIG. 16, on the upper surface of a rectangular dielectric substrate 10 with a predetermined thickness, there is provided four patches 11 each of which is the same as the patch 2*a* shown in FIG. 5. This patch 11 has a slot 12. The slot 12 is disposed radially from the center position of the dielectric substrate 10. In addition, on the lower surface of a rectangular dielectric substrate 13 with a predetermined thickness, there is provided a ground conductor plate (not shown in the figure). On the upper surface of the dielectric substrate 13, there are provided a transmission feed circuit 20 and a reception feed circuit 30. The transmission feed circuit 20 comprises a transmission microstrip feed line 21 for radially feeding a signal from the center position of the dielectric substrate 13 to the patch 11, a 90° delay line 22 for delaying the phase of the signal by 90°, and a 180° delay line 23 for delaying the phase of the signal by 180°. The reception feed circuit 30 comprises a reception microstrip feed line 31 disposed perpendicularly to the slot 12 of each patch 11, a 90° delay line 32 for delaying the phase of a signal by 90°, and a 180° delay line 33 for delaying the phase of the signal by 180°. The dielectric substrate 10 shown in FIG. 16 and the dielectric substrate 13 shown in FIG. 17 are integrally constructed so that the lower surface of the dielectric substrate 10 is brought into contact with the upper surface of the dielectric substrate 13. The transmission microstrip feed line 21 and the reception microstrip feed line 31 are disposed with an angle of 90° each other, and are not overlapped.

To operate such a four-element array antenna as a circularly polarized wave antenna, signals with phase delays of 0°, 90°, 180°, and 270° should be fed to the four patches 11 respectively. In the transmission, the 90° delay line 22 and the 180° delay line 23 delay the phase of the signals by 90°, 180°, 270° and feed the signal which is not phase-delayed and these delayed signals to the four patches 11. In the reception, the 90° delay line 32 and the 180° delay line 33 obtain signals with phase delays of 90°, 180°, and 270° from induced signals in the patches 11.

As shown in FIGS. 16 and 17, the transmission feed circuit 20 is disposed inside the area surrounded by the four patches 11, which are antenna elements. In contrast, the reception feed circuit 30 is disposed outside the area.

The microstrip line has a transmission loss of 2 dB/m or more. Thus, on condition that the output power of the transmitter is constant, it is necessary to decrease the length of the microstrip line as short as possible so as to reduce the transmission loss. Thus, as shown in FIGS. 16 and 17, by radially disposing the transmission feed circuit 20 inside the area surrounded by the four patches 11, the length of the microstrip line of the transmission feed circuit 20 can be reduced. Thus, the loss of the transmission power can be minimized. In other words, the antenna gain can be increased.

According to the antenna as shown in FIGS. 16 and 17, by disposing the transmission feed circuit 20 inside the area surrounded by the four patches 11, the overall length of the transmission feed line 20 was shortened and thereby the transmission loss was decreased. In addition, it is also possible to improve the reception sensitivity by disposing the reception feed circuit 30 inside the area surrounded by the four circular patches 11 and the transmission feed circuit 20 outside thereof. Moreover, two different frequencies can be used for reception and transmission.

According to the antenna shown in FIGS. 16 and 17, by disposing the transmission feed line or the reception feed line inside the squarely arranged four-element array antenna, the power loss with respect to one of two feed lines can be decreased. When the transmission feed circuit 20 is disposed inside the four patches 11, the required level of the output level of the transmission power amplifier can be decreased. Thus, since the output level of the power amplifier can be decreased, the efficiency of the power amplifier is improved and the size of the heat sink can be reduced. As a result, the size of the overall feed circuit of the array antenna can be reduced and the efficiency thereof can be improved. When the output of the power amplifier is constant, the antenna gain is improved. In addition, when the reception feed circuit 30 is disposed inside the squarely arranged four-element array antenna, the reception sensitivity can be improved.

The array antenna shown in FIGS. 16 and 17 generates a circular polarized wave by using four elements. However, a sequential array antenna with two or more elements can have the same effect as the array antenna shown in FIGS. 16 and 17 has.

Figure 18:
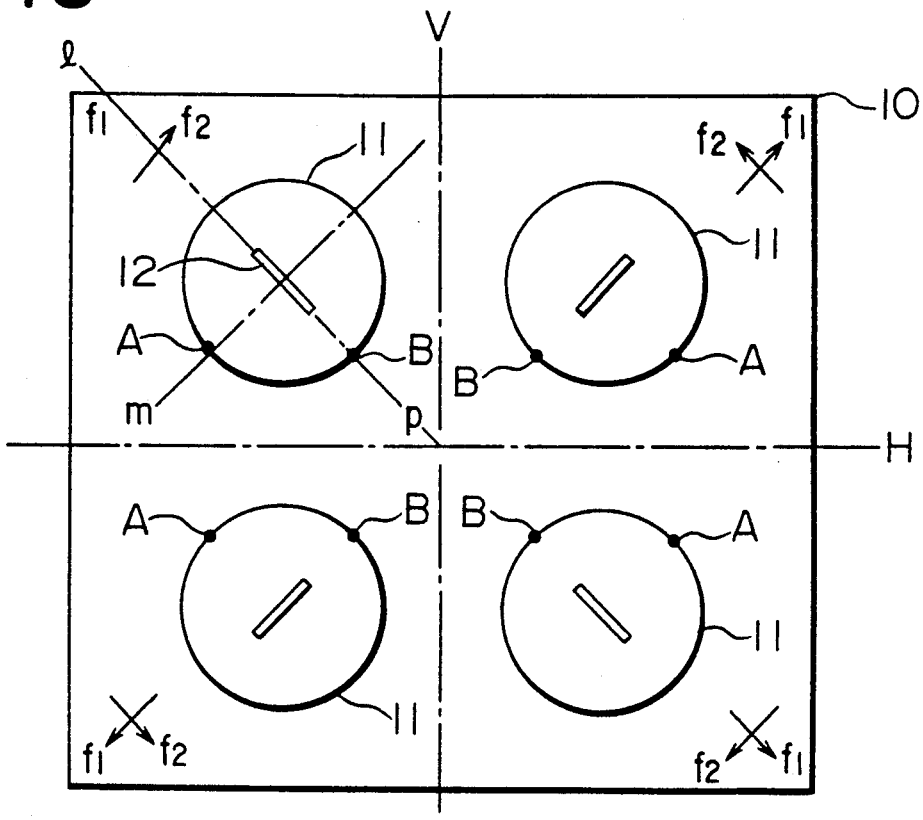
FIG. 18 is a plan view showing a construction of an antenna element portion of an array antenna in accordance with another embodiment of the present invention.
Figure 19:
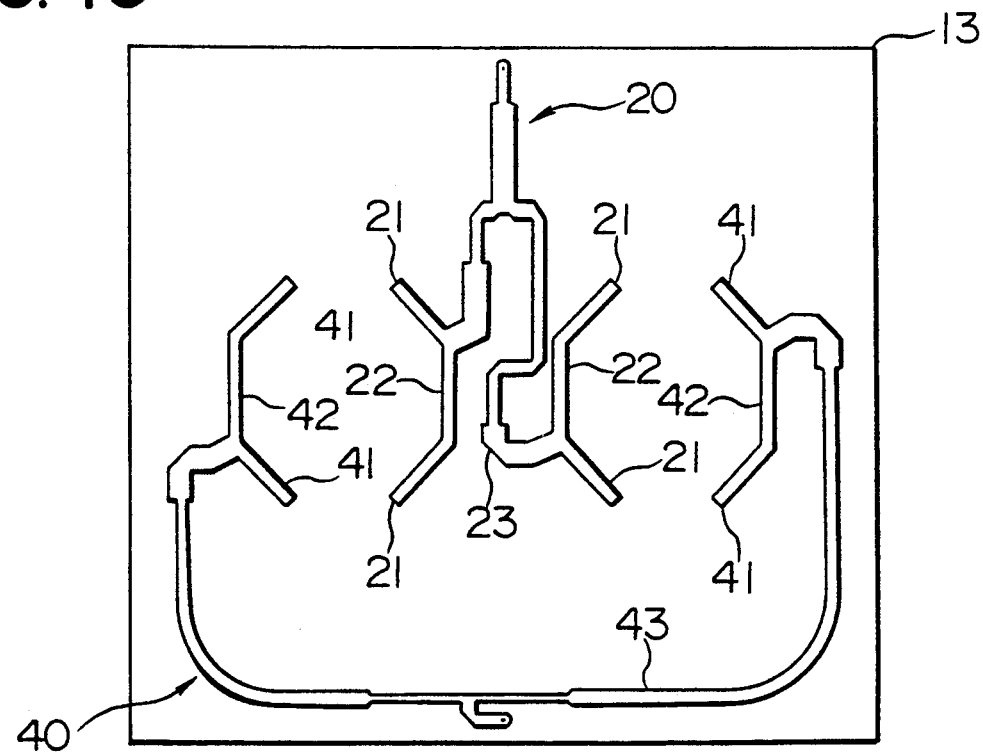
FIG. 19 is a plan view showing a construction of a feed circuit portion of the array antenna shown in FIG. 18.

FIG. 18 is a plan view showing a construction of an antenna element portion of an array antenna in accordance with another embodiment of the present invention. FIG. 19 is a plan view showing a construction of a feed circuit portion of the array antenna shown in FIG. 18. The same parts as those of the array antenna shown in FIGS. 16 and 17 are denoted by the same reference numerals and their description will be omitted for simplicity.

The construction of the array antenna shown in FIGS. 18 and 19 is the same as that shown in FIGS. 16 and 17 except that a reception feed circuit 40 is used instead of the reception feed circuit 30. Now, the reception feed circuit 40 will be described in detail.

Reference letter A represents a reception feed point of each patch. Reference letter B represents a transmission feed point of each patch. Reference letter V is a vertical line and reference letter H is a horizontal line which are two center lines for vertically and horizontally separating two patches 11 from other two patches 11, respectively. The reception feed circuit 40 comprises a reception microstrip feed line 41 for guiding a signal induced on the patch 11 from the feed point A, a 90° delay line 42 for delaying the phase of the signal by 90°, and a 180° delay line 43 for delaying the phase of the signal by 180°.

In addition, when each feed point A is disposed line-symmetrically with respect to the vertical line V and the horizontal line H which separate two patches from other two patches and the reception feed circuit 40 is constructed in the above manner, the length of the microstrip line thereof can be further shortened. Thus, the power loss of the reception feed line can be decreased and the antenna gain of the reception system can be increased. In addition, each line of the reception feed circuit 40 is not meandered and any two lines thereof, which are in close proximity to each other, are not in parallel. Moreover, by disposing the patches 11 apart from the reception feed circuit 40, the mutual coupling can be further suppressed. Thus, the circularly polarized wave characteristics of the reception antenna and the isolation between transmission and reception can be improved.

According to the above mentioned embodiment, the reception feed circuit 40 is disposed outside the area surrounded by the patches 11 and the transmission feed circuit 20 is disposed inside the area surrounded by the patches 11. In addition, like the array antenna shown in FIGS. 16 and 17, it is possible to dispose the transmission feed circuit 20 outside the area surrounded by the patches 11 and the reception feed circuit 40 inside the area.

Moreover, regardless of the effect of the feed line, because of the signal feed directions of the array antenna shown in FIG. 18, the mutual coupling between reception and transmission can be decreased. The theory of how the mutual coupling between transmission and reception is decreased will be described next.

The mutual coupling which takes place in the above mentioned array antennas is broken into the E plane mutual coupling and the H plane mutual coupling.

Figure 20:
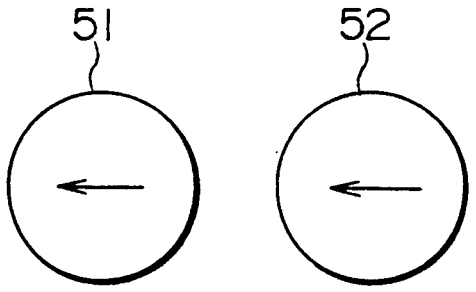
FIG. 20 is a schematic diagram describing an E (electric field) plane mutual coupling.

FIG. 20 is a schematic diagram describing an E (electric field) plane mutual coupling. In this figure, one of patches 51 and 52 is used for transmission and the other for reception. Each arrow mark represents the feed direction of each patch. For example, when the patches 51 and 52 are used for transmission and reception, respectively, even if the receiving frequency differs from the transmitting frequency, part of a radio wave which is output from the patch 51 causes a radio frequency signal to be induced on the patch 52, resulting in a mutual coupling.

Figure 21:
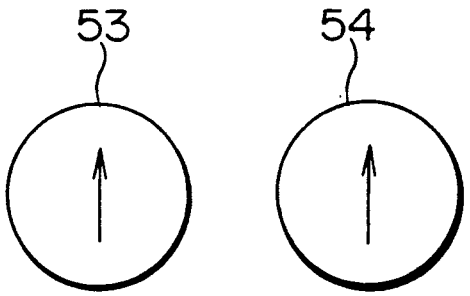
FIG. 21 is a schematic diagram describing an H (magnetic field) plane mutual coupling.

FIG. 21 is a schematic diagram describing an H (magnetic field) plane mutual coupling. In this figure, one of patches 53 and 54 is used for transmission and the other for reception. Each arrow mark represents the feed direction of each patch. For example, when the patch 53 is used for transmission and the patch 53 for reception, even if the receiving frequency differs from the transmitting frequency, part of a radio wave which is output from the patch 53 causes a radio frequency signal to be induced on the patch 54, resulting in mutual couplings. In addition, the level of mutual coupling of the E plane coupling differs from that of the H plane coupling.

Figure 26:
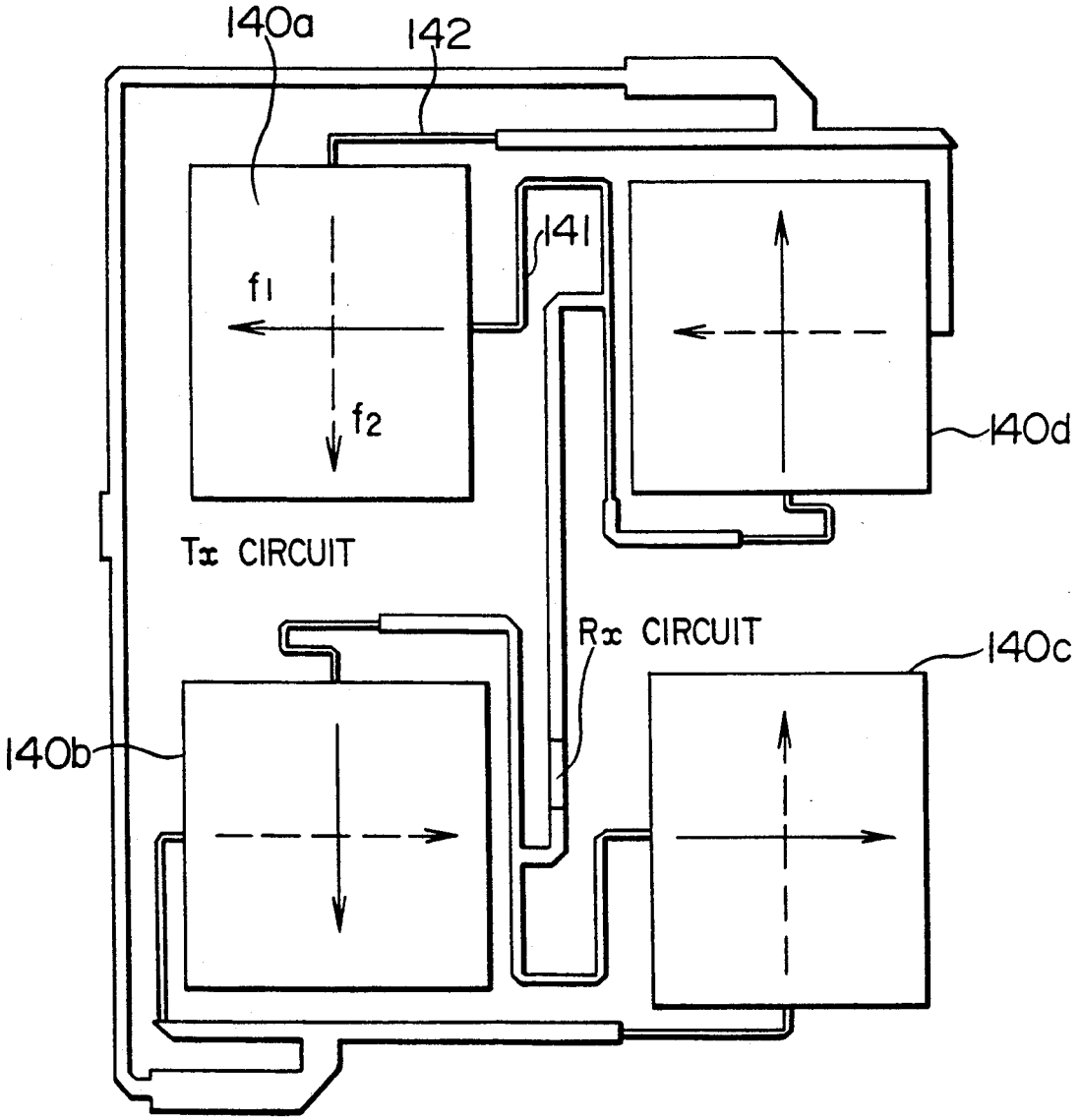
FIG. 26 PRIOR ART
FIG. 26 is a plan view showing a construction of a conventional microstrip antenna having four antenna elements for both transmission and reception, the antenna generating a circularly polarized wave.

Next, consider, for example, adjacent patches 140*a*, 140*b* as shown in FIG. 26.

When the patch 140*a* transmits a signal and the patch 140*b* receives a signal, the E plane coupling occurs. In contrast, when the patch 140*b* transmits a signal and the patch 140*a* receives a signal, the H plane coupling occurs. As a result, the level of the mutual coupling with respect to the patch 140*a* differs from that with respect to the patch 140*b*. Thus, the mutual coupling component which is not offset by the reception feed circuit resides.

Figure 22:
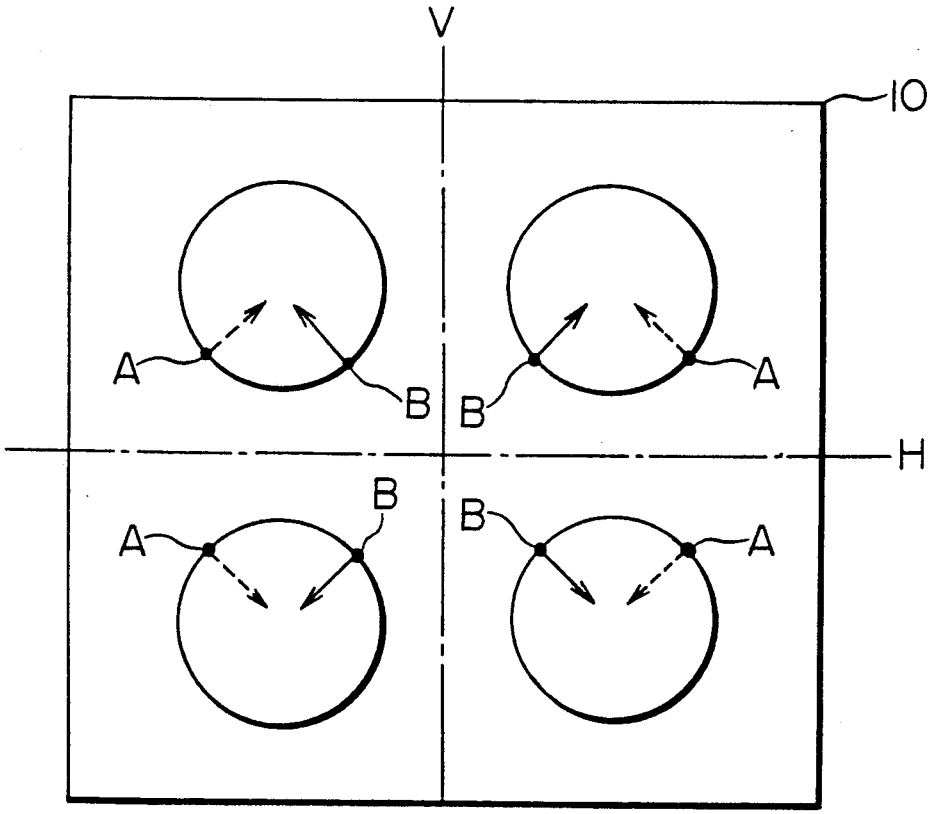
FIG. 22 is a schematic diagram showing feed points and direction of polarized waves for transmission and reception shown in FIG. 18.

FIG. 22 is a schematic diagram showing feed points and directions of polarized waves for transmission and reception shown in FIG. 18. In FIG. 22, the solid line represents transmission, whereas the dot line represents reception.

As shown in the figure, according to the adjacent patches, the level of the E plane mutual coupling is equal to that of the H plane mutual coupling. Thus, the mutual coupling component which takes place in each patch is offset by the reception feed circuit. In addition, according to the two patches diagonally disposed, since the transmission feed direction is perpendicular to the reception feed direction, the level of mutual coupling is very low.

The mutual couplings among the four patches are completely offset because of the feed phase difference for generating circularly polarized waves in the reception circuit and the transmission circuit.

Figure 23:
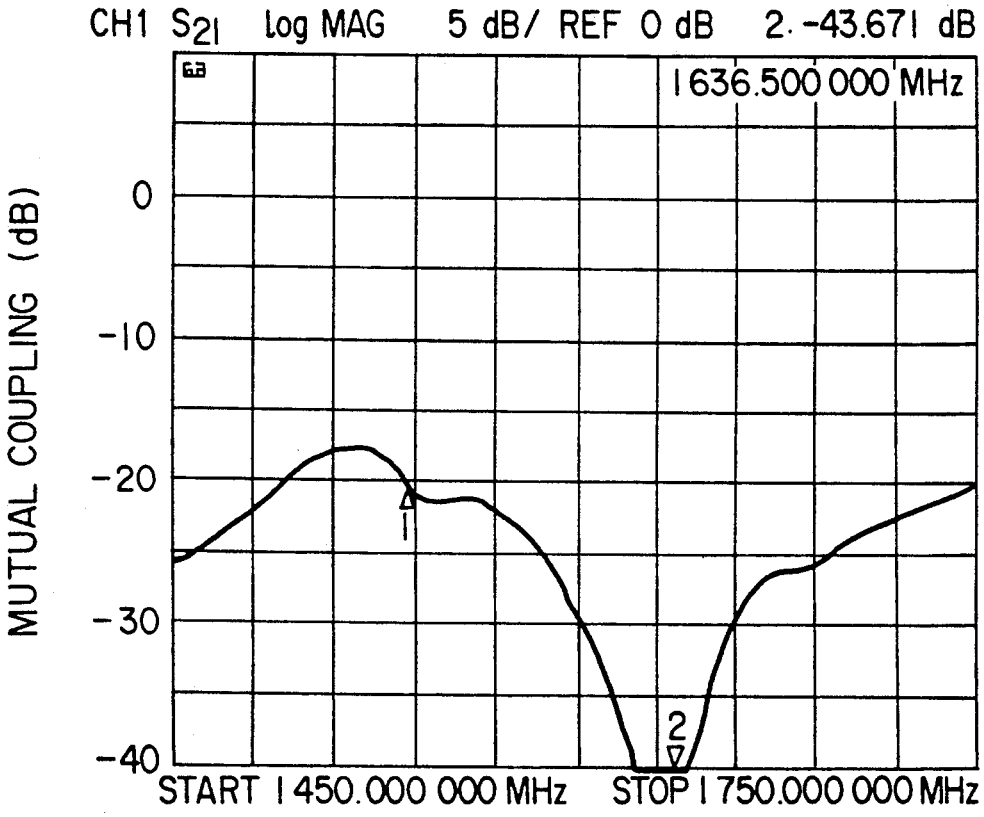
FIG. 23 is a chart showing mutual couplings between transmission and reception of the array antenna shown in FIGS. 18 and 19.

FIG. 23 is a chart showing a mutual couplings between transmission and reception of the array antenna shown in FIGS. 18 and 19.

As shown in FIG. 23, the mutual coupling between transmission and reception can be remarkably reduced to −43.671 dB with a transmission frequency of 1636.5 GHz.

The array antenna shown in FIG. 18 has circular patches with a slot. However, it is possible to dispose patches in any shape such as rectangular, ellipse, and another shape where two orthogonally polarized waves with two difference resonance frequencies are generated. Moreover, according to the above mentioned embodiment, an adjacent coupling feeding which is an electromagnetic coupling feeding is used. However, the same effect can be obtained with a slot coupling feeding.

Figure 24:
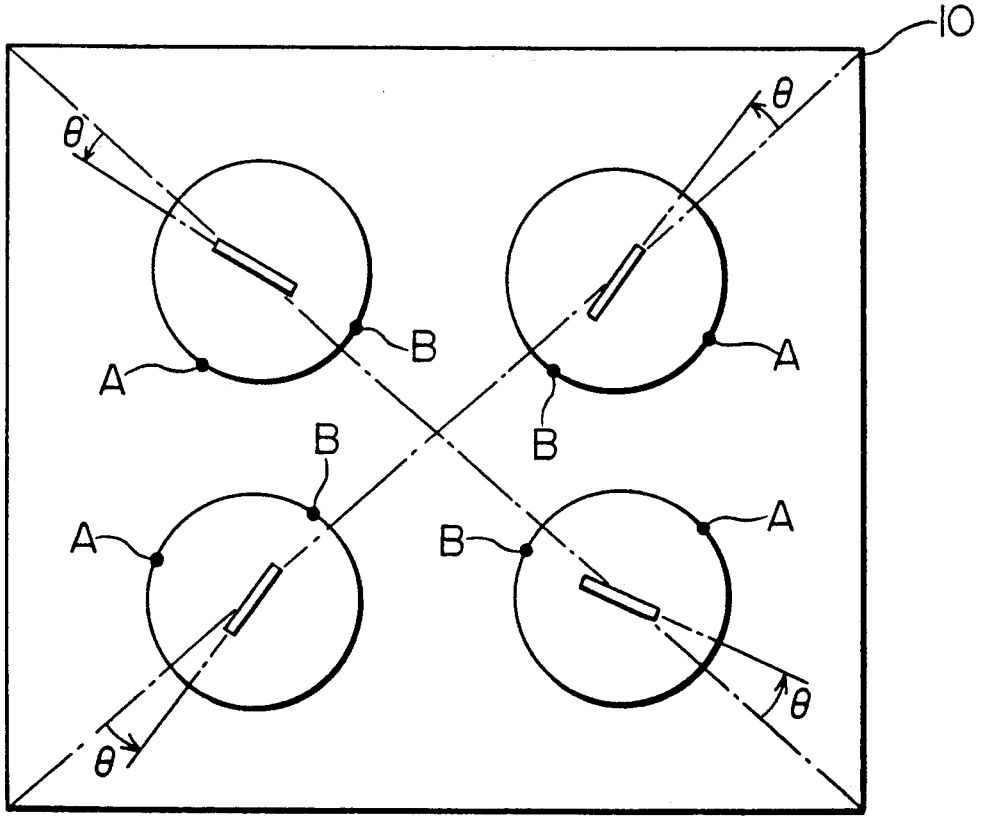
FIG. 24 is a plan view showing an array antenna where the antenna elements of the array antenna shown in FIG. 18 are rotated by an angle $\theta$ in the same direction.

Moreover, besides an arrangement of the line-symmetry with respect to the two center lines which divide antenna elements into two portions as shown in FIG. 24, the same effect can be obtained when each antenna element is rotated by a particular angle $\theta$ from the arrangement shown in FIG. 18.

What is claimed is:

1. A microstrip antenna, comprising:

a substrate having a particular permittivity;

an even number of antenna elements disposed on said substrate in a radial pattern from a central point such that a center portion of each of the antenna elements is positioned on a radial line passing through the central point;

an even number of first feed lines for successively feeding a first high frequency signal to the antenna elements in order of a first rotational direction about the central point, each of the first feed lines extending along the radial lines to intersect with each of the antenna elements respectively; and an even number of second feed lines for successively feeding a second high frequency signal to the antenna elements in order of a second rotational direction about the central point, the frequency of the second high frequency signal being different from the frequency of the first high frequency signal, the second rotational direction being in reverse to the first rotational direction, each of the second feed lines extend along a line which is perpendicular to the respective radial lines along which the first feed lines extend, each of the second feed lines being line-symmetrical with respect to a straight line which extends through the central point to a midpoint between two adjacent antenna elements.

2. The microstrip antenna according to claim 1 wherein said first feed lines are transmission feed means for feeding a signal to said antenna elements, said second feed lines are reception feed means for guiding a radio frequency signal induced in said antenna elements.

3. The microstrip antenna according to claim 1 wherein said first feed lines are reception feed means for guiding a radio frequency signal induced in said antenna elements, said second feed lines are transmission feed means for feeding a signal to said antenna elements.

4. The microstrip antenna according to claim 1 wherein said first feed lines and said second feed lines have phase delay means for delaying the phases of signals by 90° and feeding the signals to said antenna elements, respectively.

5. The microstrip antenna according to claim 1 wherein said first feed lines and said second feed lines feed signals to said antenna elements by electromagnetic coupling.

* * * * *

UNITED STATES PATENT AND TRADEMARK OFFICE

CERTIFICATE OF CORRECTION

PATENT NO. : 5,287,116

DATED : February 15, 1994

INVENTOR(S) : Hisao IWASAKI et al.

It is certified that error appears in the above-indentified patent and that said Letters Patent is hereby corrected as shown below:

On the title page:

Assignee, Front Page, line 2, change "Kawagawa" --Kanagawa--.

Signed and Sealed this

Sixth Day of December, 1994

*Attest:*

*Attesting Officer*

BRUCE LEHMAN

*Commissioner of Patents and Trademarks*